US007043764B2

(12) United States Patent
Sky

(10) Patent No.: US 7,043,764 B2
(45) Date of Patent: May 16, 2006

(54) COMBINED CONTAINER AND GARMENT PROTECTION DEVICE

(76) Inventor: Asher Sky, 5105 Crossfield Ct., # 14, Rockville, MD (US) 20852

( * ) Notice: Subject to any disclaimer, the term of this patent is extended or adjusted under 35 U.S.C. 154(b) by 299 days.

(21) Appl. No.: 10/668,192

(22) Filed: Sep. 24, 2003

(65) Prior Publication Data

US 2004/0098781 A1 May 27, 2004

Related U.S. Application Data

(60) Provisional application No. 60/428,919, filed on Nov. 26, 2002.

(51) Int. Cl.
*A41B 13/00* (2006.01)

(52) U.S. Cl. ..... 2/49.1

(58) Field of Classification Search ..... 2/49.1, 2/49.2, 49.3, 49.4, 49.5, 50, 51, 52, 48, 247, 2/46

See application file for complete search history.

(56) References Cited

U.S. PATENT DOCUMENTS 4,569,086 A * 2/1986 Takefman ..... 2/49.2
4,797,952 A 1/1989 Petrini
4,946,094 A 8/1990 Stang
5,046,980 A * 9/1991 Tai et al. ..... 446/73
5,056,159 A 10/1991 Zemke, Jr.
5,062,558 A 11/1991 Stang
5,075,897 A 12/1991 Daniels
5,244,278 A 9/1993 Robitaille
5,265,783 A 11/1993 Iqbal
5,328,265 A 7/1994 Clooney
5,530,968 A 7/1996 Crockett
5,649,654 A 7/1997 Hayward, Jr.
5,701,605 A 12/1997 Bowen
5,875,490 A 3/1999 Woodard et al.
5,915,530 A 6/1999 Hager
5,956,763 A 9/1999 Blackshear
6,000,056 A 12/1999 Brady et al.
6,243,869 B1 6/2001 Ekovich
6,334,220 B1 1/2002 Frye
6,490,731 B1 12/2002 Hyatt
6,530,089 B1 3/2003 Frye
6,536,048 B1 3/2003 Frye

* cited by examiner

*Primary Examiner*—Tejash Patel

(57) ABSTRACT

A combined container and garment protection device includes a support section with an open portion, and a container section including a pocket to receive and retain items placed within the pocket. The support section is adapted to support the device about the neck of a user. The support section is releasably engageable with the container section to form a handle to facilitate transport of the device prior to being supported about the neck of the user.

9 Claims, 2 Drawing Sheets

COMBINED CONTAINER AND GARMENT PROTECTION DEVICE

CROSS REFERENCE TO RELATED APPLICATION

This application claims priority from U.S. Provisional Patent Application Ser. No. 60/428,919, entitled "Combined Container and Bib" and filed Nov. 26, 2002. The disclosure of the above-mentioned provisional application is incorporated herein by reference in its entirety.

BACKGROUND OF THE INVENTION

1. Field of the Invention

The present invention pertains to a combined container and garment protection device wearable by a user to permit the user to access items disposed within a pocket of the device.

2. Description of the Related Art

Eating and drinking during travel in an automobile or other moving vehicle has become routine in daily life, particularly with the implementation of drive-through windows at many fast food restaurants and convenience stores that provide ready made food for immediate consumption. For people with jobs involving a large proportion of commuting from one location to another, the combination of eating meals while commuting is very common. The problem with eating a meal while commuting is the increased potential for food and/or beverages spilling on the clothes of the person. For people dressed in business attire, it is of considerable importance to minimize or prevent the risk of food or beverages soiling one's clothing. In addition, it is often difficult to find places in which to place items to be consumed or used when eating a meal while commuting in a moving vehicle.

A number of garment protection devices have been designed with the purpose of assisting a person who is eating in a moving vehicle. For example, U.S. Pat. Nos. 4,946,094, 5,062,558 6,334,220, 6,530,089 and 6,536,048 disclose tray or container systems for holding items, such as food and/or beverages, for allowing one to eat a meal while commuting in a moving vehicle. Each of the devices includes a support member to support the device about the neck of the user during use.

While each of the devices described in these patents is useful in assisting one in eating a meal while commuting in a vehicle, these devices are not readily adaptable for use in fast food restaurants and/or convenience stores that sell ready-to-eat food items for consumers. In particular, these devices include a number of parts or components, resulting in a considerable expense per unit to manufacture. In a fast food or convenience store environment, it would be desirable to provide a garment protection device that also serves as a container for storing food and/or other items, where the device can be mass produced at a minimal expense.

SUMMARY OF THE INVENTION

Therefore, in light of the above, and for other reasons that become apparent when the invention is fully described, an object of the present invention is to provide a garment protection for use by an individual that also serves as a container for placing items such as food and beverages.

It is another object of the present invention to provide a combined container and garment protection device that is useful for eating meals while commuting.

It is a further object of the present invention to provide a combined container and garment protection device that requires minimal expense to manufacture and is readily adaptable for use in fast food restaurants and convenience stores.

The aforesaid objects are achieved individually and in combination, and it is not intended that the present invention be construed as requiring two or more of the objects to be combined unless expressly required by the claims attached hereto.

In accordance with the present invention, combined container and garment protection device includes a support section with an open portion, and a container section including a pocket to receive and retain items placed within the pocket. The support section is adapted to support the device about the neck of a user. The support section is releasably engageable with the container section to form a handle to facilitate transport of the device prior to being supported about the neck of the user. In a preferred embodiment, the pocket of the container section includes a slot suitably dimensioned to permit at least a portion of the support section to be inserted through the slot to form the handle.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DETAILED DESCRIPTION OF THE PREFERRED EMBODIMENTS

Figure 1:
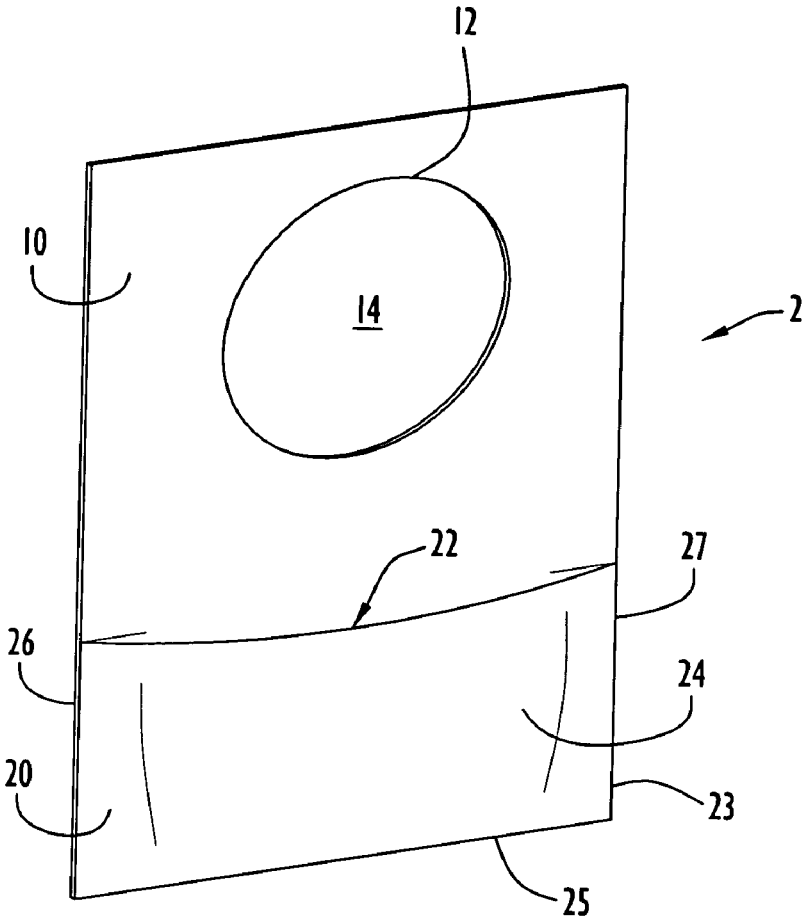
FIG. 1 is a view in perspective of a combined container and garment protection device of the present invention in an extended orientation.
Figure 2:
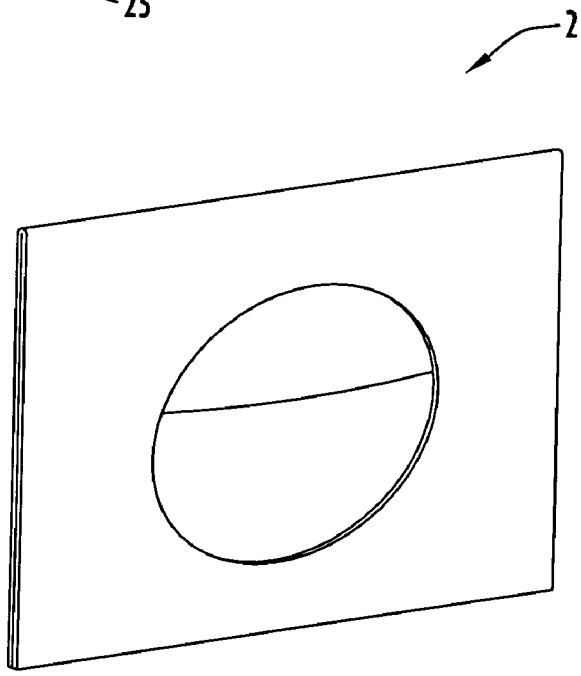
FIG. 2 is a view in perspective of the device of FIG. 1 in a folded orientation.

A combined container and garment protection device 2 includes a support section 10 and a container section 20. Device 2 has a generally rectangular configuration in both extended and folded orientations as described below and as depicted in FIGS. 1 and 2. However, it is noted that the device may have any suitable geometric configurations in the extended and/or folded positions (e.g., rounded, multi-sided, etc.). In the extended orientation, support section 10 of device 2 is oriented in an upper position with respect to container section 20 to facilitate use of the device as described below.

Support section 10 is generally rectangular in configuration and includes a cut-out section 12 defining a generally circular aperture 14 in the support section. The aperture is suitably sized to permit the head of the user of the device to be inserted through the aperture to facilitate wearing of the device around the user's neck during use. Alternatively, it is noted that the aperture formed in the support section may have any other selected geometric configuration (e.g., square, multifaceted, etc.).

Container section 20 is generally rectangular in configuration and includes a pocket 22 formed by a rear wall 23 and a front wall or cover 24 that extends between opposing edges of device 2 to enclose at least a portion of the container section. The cover is secured to the device at its lower edge 25 and opposing side edges 26, 27 in any suitable manner (e.g., via adhesion, a heat or other weld, a seam, etc.). Alternatively, cover 24 may be formed by folding a portion of container section 20 upon itself and securing opposing side edges of the cover to the device (e.g., by adhesion, heat or other welding, a seam, etc.) to obtain the pocket.

The device is constructed of any suitably flexible material that is preferably lightweight and disposable after use. Exemplary materials of construction for the device include, without limitation, plastics (e.g., polyethylene, polypropylene, etc.) and paper, where the materials are preferably formed in one or more sheets of any selected millimeter (mil) thickness and the one or more sheets are in turn combined to form the device. Preferably, the device is constructed of materials that provide a liquid impermeable barrier for beverages and food spills. The materials may include transparent and/or translucent portions to permit viewing of items disposed in the container section. The device may further include any types of selected indicia (e.g., company logos, cartoon caricatures, advertising, etc.) to enhance the ornamental design of the device and/or convey information to the user of the device. Optionally, the device may further include liquid absorbent materials to provide further protection to the user's garment against beverage spills during use of the device in the garment protection configuration.

Preferably, the device is constructed of a single sheet of plastic material forming the support and container sections, with the plastic material has a thickness in the range of no greater than about 2 mils and the cover is formed by folding a portion of the container section upon itself and securing opposing side edges of the cover in a manner as described above. Constructing the device in this manner reduces the number of components and manufacturing steps, which in turn reduces manufacturing costs for mass production of the device.

Device 2 is depicted in FIG. 1 in an unfolded and wearable position, whereas the device is depicted in a folded position in FIG. 2. In the folded position, the device is folded at a selected location between support section 10 and container section 20. Preferably, the device is folded such that the upper and lower edges of the device are substantially coplanar with each other. While FIG. 2 depicts a single fold of the device, it is noted that any selected number of folds may be applied to the device, depending upon a desired shape and size to be achieved for the device in the folded position. In one multifolded embodiment, the device may be folded twice to achieve a final folded orientation, where the device is first folded by bending the support section such that the upper edge of the device engages an intermediate portion of the support section. The device is then folded a second time such that the upper portion of the folded support section meets the lower edge of the device.

The combined container and garment protection device is suitably sized to receive items within the pocket for access by the user as the device is supported around the user's neck. Preferably, the device is configured for use in fast food restaurants and/or convenience stores. In this embodiment, the pocket is suitably sized to receive food items (e.g., solid and/or liquid foods and beverages) that may be consumed by the user as the user wears the device around his or her neck. In an exemplary embodiment, the device may have a longitudinal dimension of at least about 20 inches (preferably about 24 to 25 inches), a shorter dimension of at least about 13 inches (preferably about 14 inches), a pocket extending about 8 inches (preferably about 9 inches) from the lower edge to an intermediate portion of the device, and a generally circular aperture formed in the support section that is preferably at least about 12 inches in diameter. However, it is noted that the device may include any suitable dimensions based upon a variety of desired uses.

Use of the device in a restaurant environment is now described with reference to FIGS. 1 and 2. In particular, use of the device is described in relation to a fast food restaurant, where a restaurant employee is serving a customer via a conventional drive through window service. Specifically, a plurality of devices 2 are maintained by the restaurant to dispense food items to customers. Optionally, the devices are stored in the folded position (e.g., in the position depicted in FIG. 2) prior to being used. Upon receiving a drive through order from a customer, the employee takes a device 2 and unfolds it (if initially folded). Food items ordered by the customer (e.g., hamburgers, French fries, etc.) are placed within pocket 22 of the device. Optionally, the employee folds the device, such that the pocket is covered by the support section (e.g., as depicted in FIG. 2), and transfers the device including the food items stored in the pocket to the customer through the drive through window. The customer unfolds the device to the position depicted in FIG. 1, supports the device by putting his or her head through aperture 14 in the support section, and proceeds to remove food items from the pocket to eat. When finished eating, device 2 may be discarded or, alternatively, reused for another meal. Any food or other contents remaining after the meal may be placed in the pocket and discarded with the device.

The combined container and garment protection device may be similarly used in a convenience store environment. For example, food items such as sandwiches may be individually sold in combination with the device of the invention. In particular, food items may be packaged within the device by placing the food items within pocket 22 and then folding support section 10 over container section 20. Optionally, the support section can be releasably secured to the container section utilizing any suitable adhesive or fastener (e.g., hook and loop fasteners). When a consumer purchases the food items with the device, the support section is disengaged from the container section, and the consumer places his or her head through aperture 14 and utilize the device in a similar manner as described above.

The device provides a combined container for food as well as a garment protector effective to prevent foods from staining the user's clothing while the user is eating food from the pocket of the device. The device is further an effective holder for the food items that are being consumed by the user, particularly when the user is driving a vehicle while eating food supported by the device. In addition, the device catches and minimizes or prevents spills of food items in the user's vehicle. Further, the device facilitates more efficient productivity for the restaurant or other employee serving food and/or beverage items to the consumer, which is an important feature in today's fast paced food industry.

Figure 3:
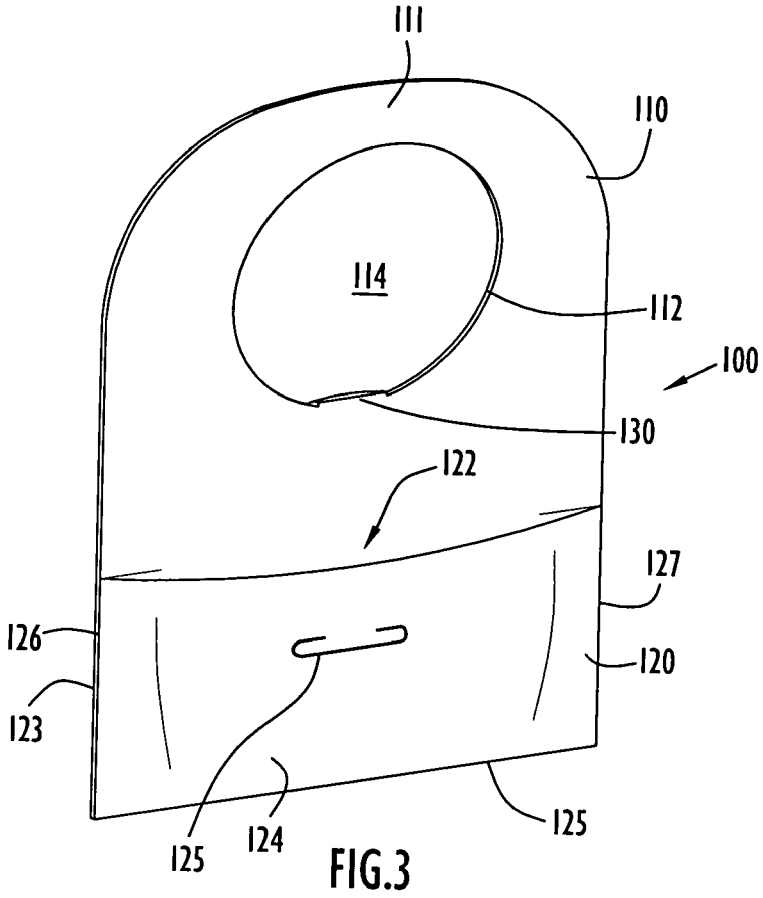
FIG. 3 is a view in perspective of an alternative embodiment of a combined container and garment protection device of the present invention in an extended orientation.
Figure 4:
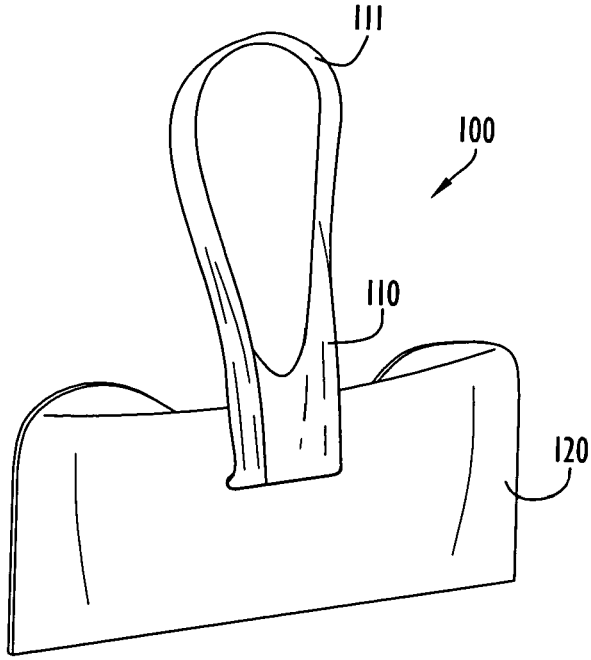
FIG. 4 is a view in perspective of the device of FIG. 3 in an arrangement in which the support section of the device serves as a carrying handle.

The device described above can be modified to provide a handle that facilitates easy carrying of the device when items are stored within the pocket. In particular, the device can be modified to include a slot that receives the support section and allows the support section to serve as a handle prior to the device being worn by a user. Referring to FIGS. 3 and 4, a device 100 includes a support section 110 and a container section 120 that are similar to the same sections for the device described above and illustrated in FIGS. 1 and 2. The support section includes a cut-out section 112 defining a generally circular aperture 114 that is suitably sized to permit the head of the user of the device to be inserted through the aperture to facilitate wearing of the device around the user's neck during use.

The cut-out section of the support section of the device includes a flap 130 attached to a lower portion of the cut-out section. The flap is provided by cutting away only a portion of the material from the device during formation of the cut-out section. As depicted in FIG. 3, flap 130 extends through cut-out section 114 so as to hang downward toward container section 120 along a rear surface of the device. The flap may be inserted into and folded around the user's collar during use of the device as a garment protector to provide further coverage and protection against food and/or beverage spills. The flap in the embodiment of FIG. 3 may also be modified to include sections that are releasably secured (e.g., via perforations) to the support section so as to substantially retain the flap within the cut-out section prior to the device being used in as a garment protector.

Support section 110 is rounded at the upper portion of the device. Container section 120 includes a rear wall 123 and a front wall or cover 124 that extends between opposing edges of device 100 and is secured at a lower edge 125 and opposing side edges 126, 127 of the device (e.g., via adhesion, a heat or other weld, a seam, etc.) to form a pocket 122. Alternatively, cover 124 may be formed by folding a portion of container section 120 upon itself and securing opposing side edges of the cover to the device (e.g., by adhesion, heat or other welding, a seam, etc.) to obtain the pocket.

An opening or slot 125 is provided in cover 124 and is suitably sized (e.g., no greater than about three inches in major dimension) to permit portions of support section 110 to loop through the slot to form a convertible handle for the device. Preferably, the slot is disposed at an upper portion of the cover and is formed by a partially cut-out flap as depicted in FIG. 3. However, the slot may be formed in any suitable manner, have any suitable geometric configuration and may be disposed at any suitable location along the cover.

The handle is formed by insertion of an upper portion 111 of support section 110 (i.e., the portion of the support section that is located above cut-out section 112) into pocket 122 and then pulling the support section through slot 125. The portion of support section 110 extending through slot 125 forms a handle, as shown in FIG. 4, that allows the device to be transported via the handle in the container configuration prior to being utilized as a garment protector. In this configuration, the device may be easily converted to the garment protector by withdrawing the support section from the slot so that the user may insert his or her head through the cut-out section. In addition, the pocket is covered in this configuration by lower portions of the support section to prevent inadvertent loss of items stored within the pocket prior to being consumed.

Alternatively, the handle may be formed by first inserting the upper portion of the support section through the slot and into then into the pocket, followed by pulling the upper portion of the section through the cut-out section. Further, the rear wall of the container section may also include an opening or slot that complements the slot in the cover in order to permit insertion of the support section through the cover and rear wall in a suitable manner to form the handle.

It is noted that the device is preferably constructed of suitable materials such that upper portion of the support section is sufficiently sturdy to resist tearing when utilized as a handle. The device is further preferably resilient to permit slight deformation of the support section when engaged with the container section to form a handle (e.g., as depicted in FIG. 4), while generally reverting to a supporting configuration for the device (e.g., as depicted in FIG. 3) when the support section is disengaged from the container section.

It will be appreciated that the embodiments described above and illustrated in the drawings represent only a few of the many ways of implementing a combined container and garment protection device.

The device may be modified to include a support section that is formed with a minimal amount of material. For example, the support section may include a cord, a thin strip of material, or any other suitable structure that facilitates support of the container around a user's neck. Such an embodiment reduces the amount of material necessary to construct the device, which in turn reduces the manufacturing costs for mass production of the device.

The device may include additional features to enhance use of the device. For example, as an alternative to the convertible handle described above, the device may include a handle disposed at any suitable location on the device to facilitate easy transfer of the device, e.g., between a restaurant employee and a customer. The device may further include any suitable securing device for releasably securing the support section to the container section, or any two or more portions of the device, when the device is in a folded position. For example, the device may include a suitable adhesive member (e.g., adhesive tape, hook and loop fasteners, etc.) disposed at one or more suitable locations on the support section and/or container section so as to releasably secure the support section to the container section when the device is in a folded position.

The pocket cover may include sections that are releasably secured (e.g., via perforations) to the rear wall of the container section to permit selective expansion of the pocket during use of the device. This expanding pocket feature allows the pocket to accommodate items of varying sizes, such as plastic or cardboard trays containing food items.

The device is not limited for use with fast food restaurants and/or convenience stores. Rather, the device may be utilized in any environment in which food is being consumed. For example, the device may be used in full service restaurants, in supermarkets, delis, coffee shops, etc. In addition, the combined container and garment protection device can be utilized in other environments that are not associated with food consumption. For example, the device can be used to store and hold other items for use by a person (e.g., a purse, a bag for carrying tools, etc.).

Having described novel methods and apparatus for a combined container and garment device, it is believed that other modifications, variations and changes will be suggested to those skilled in the art in view of the teachings set forth herein. It is therefore to be understood that all such variations, modifications and changes are believed to fall within the scope of the present invention as defined by the appended claims and their equivalents.

What is claimed is:

1. A combined container and garment protection device comprising:

a support section including an open portion, the support section being adapted to support the device about the neck of a user; and a container section including a pocket to receive and retain items placed within the pocket;

wherein the support section is releasably engageable with the container section to form a handle to facilitate transport of the device prior to being supported about the neck of the user, and the pocket of the container section includes a slot suitably dimensioned to permit at least a portion of the support section to be inserted through the slot to form the handle.

2. The device of claim 1, wherein the support section is suitably dimensioned to cover a majority of an entrance to the pocket when the support section is inserted through the slot to from the handle.

3. The device of claim 1, wherein the container section and support section are formed from a continuous sheet of material, with a first portion of the container section being folded upon a second portion of the container section to form the pocket.

4. A method of storing items and protecting a user's garment, the method comprising:

providing a combined container and garment protection device including a support section with an open portion and a container section with a pocket;

inserting items within the pocket; and inserting at least a portion of the support section through a slot defined on the pocket to form a handle that facilitates transport of the device.

5. The method of claim 4, wherein the support section is suitably dimensioned to cover a majority of an entrance to the pocket when the support section is inserted through the slot to from the handle.

6. The method of claim 4, further comprising:

disengaging the support section from the container section; and inserting the user's neck through the open portion of the support section to support the device about the neck of the user.

7. The method of claim 4, wherein food items are inserted within the pocket.

8. The method of claim 4, further comprising:

forming the container section and support section from a continuous sheet of material, wherein a first portion of the container section is folded upon a second portion of the container section to form the pocket.

9. A combined container and garment protection device comprising:

a support section including an open portion, the support section being adapted to support the device about the neck of a user; and a container section including a pocket to receive and retain items placed within the pocket;

wherein the container section and support section are formed from a continuous sheet of material, a first portion of the container section is folded upon a second portion of the container section to form the pocket, and the support section is releasably engageable with the container section to form a handle to facilitate transport of the device prior to being supported about the neck of the user.

* * * * *